United States Patent [19]

Hummel

[11] 4,204,316

[45] May 27, 1980

[54] METHOD OF MANUFACTURE OF A HEATER BAND

[75] Inventor: Matt N. Hummel, Glenview, Ill.

[73] Assignee: Acra Electric Corporation, Schiller Park, Ill.

[21] Appl. No.: 930,684

[22] Filed: Aug. 3, 1978

[51] Int. Cl.[2] ..... H01C 3/18

[52] U.S. Cl. ..... 29/61 N; 29/613; 29/618; 29/619; 219/535

[58] Field of Search ..... 29/610 R, 611, 613, 29/618, 619; 219/535, 536

[56] References Cited

U.S. PATENT DOCUMENTS

| | | | |
|---|---|---|---|
| 1,042,432 | 10/1912 | Hadaway | 29/611 |
| 1,150,426 | 8/1915 | Hadaway | 29/613 |
| 1,993,410 | 5/1935 | Lightfoot | 29/618 |
| 2,163,798 | 6/1939 | Mucher | 29/618 |
| 2,956,325 | 10/1960 | Browne | 24/271 |
| 2,976,387 | 3/1961 | Browne | 219/536 |
| 3,619,566 | 11/1971 | Finch | 219/535 |
| 3,808,573 | 4/1974 | Cappell | 29/619 |
| 4,131,788 | 12/1978 | Fulbrook | 219/535 |

*Primary Examiner*—Francis S. Husar
*Assistant Examiner*—Gene P. Crosby
*Attorney, Agent, or Firm*—Wegner, Stellman, McCord, Wiles & Wood

[57] ABSTRACT

A heater band formed of an extruded metal channel member and a heater plate assembly received within a slot extending along the length of the channel. The heater plate assembly and the extrusion are compressed together to provide a heater band having a dense cross section resulting in improved heat transfer characteristics. The heater band in accordance with the present invention has a longer life and higher heating capabilities than heater bands known to the prior art.

12 Claims, 8 Drawing Figures

METHOD OF MANUFACTURE OF A HEATER BAND

BACKGROUND OF THE INVENTION

This invention relates to electric heating and, more specifically, to an improved heater band and a method for making the band.

Heater bands are known for heating a container, as for example an extruder barrel containing a plastic melt or a water heater. Such a heater band is disclosed in Browne U.S. Pat. No. 2,976,387, owned by the assignee of the present invention. The heater band includes a heating element carried by and electrically insulated from a cover and a base, both of thin sheet metal. The base includes tabs or flanges which are folded over the cover to retain the electric heating element between the cover and the base. The sheet metal is of low mass, and when the underside of the base is in intimate contact with the container to be heated, satisfactory heat transfer from the heater band to the container takes place.

Two related problems arise with the heater band described above. First, if the band separates from the barrel creating a space therebetween, the heat transfer from the heating element to the container is reduced and the heating element becomes overheated since the sheet metal cannot sufficiently and adequately absorb the additional heat which was not dissipated as a result of inefficient heat transfer between the heating element and the container. This reduces the operational life of the heating element. Second, the wattage of the heating element must be selected to be less than the maximum possible wattage to assure that the heating element does not burn out if the band separates from the container.

SUMMARY OF THE INVENTION

In accordance with the present invention, a heater band is provided having a compressed, thick cross section to dissipate large amounts of heat so that the need for maintaining the heater band in intimate contact with the container to be heated is not as critical as with prior heater bands. The heater band includes a metal channel member having a slot which extends along its length and a heater plate assembly received within the slot. The channel member is preferably a metal extrusion, as of aluminum. The heater plate assembly is formed by securing a heating element to a thick metal cover plate. The heater plate assembly is slid into the channel member slot. The channel member and the heater plate assembly are then compressed to assure intimate contact therebetween and good heat transfer from the heating element to the channel member.

It is a feature of the invention that the heater band has a dense cross section and sufficient mass to dissipate the heat from the heating element so that the element will not burn out if heat transfer from the heater band to an adjacent container is disrupted.

Another feature is that the heater band may have higher wattage for a given size than heretofore practical without decreasing the operational life of the band.

Yet another feature of the present invention is the method of manufacturing the heater band in which the parts are of relatively thick metal and are compressed to provide the improved characteristics described above.

DRAWINGS

FIG. 1, prior art, is a perspective view of a container, as an extruder barrel, having heater bands known to the prior art.

FIG. 2, prior art, is a cross-sectional view taken through the line 2—2 of FIG. 1;

Figure 6:
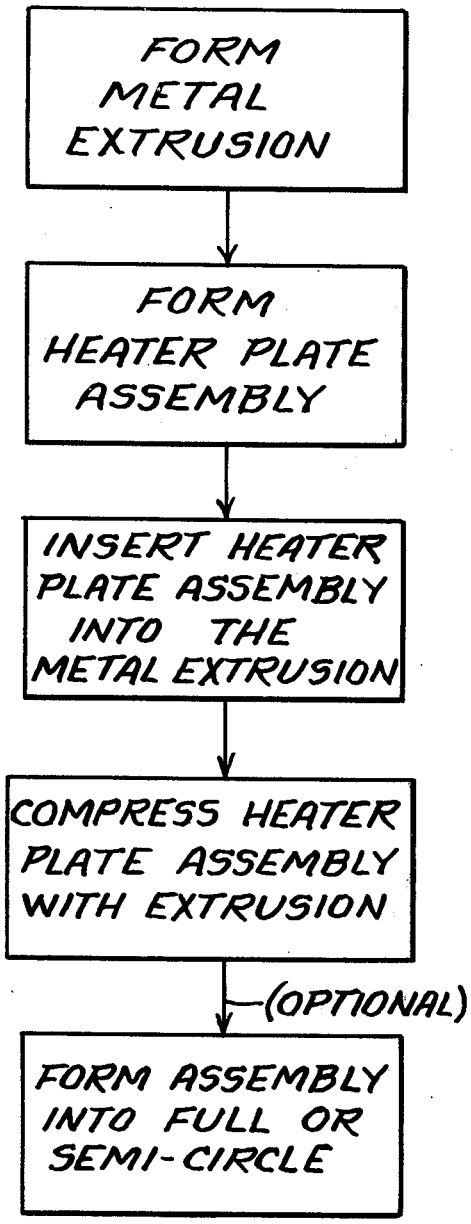
Figure 7:
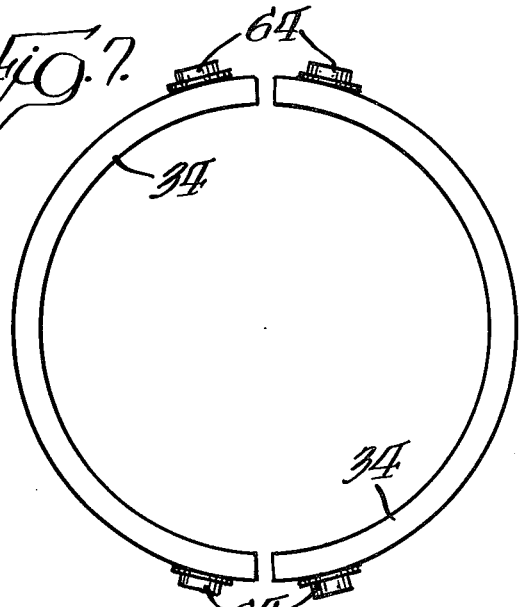

FIG. 6 outlines the method steps in making the heater band;

FIG. 7 is a diagrammatic view showing the heater band in semicircle form; and

Figure 8:
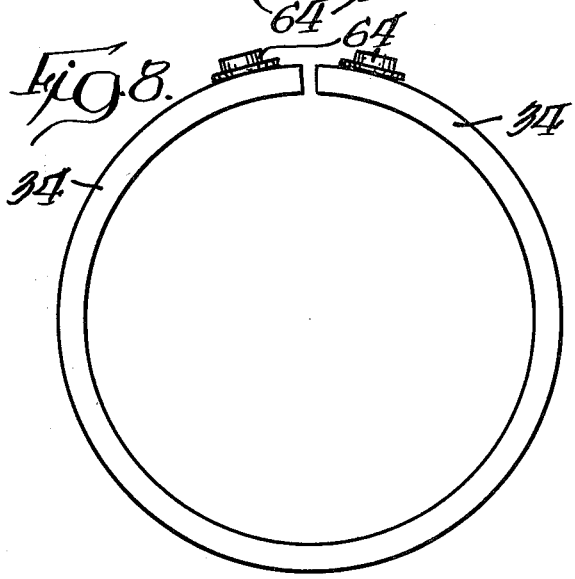

FIG. 8 is a diagrammatic view showing the heater band formed in a circle.

DESCRIPTION OF THE PRIOR ART

Figure 1:
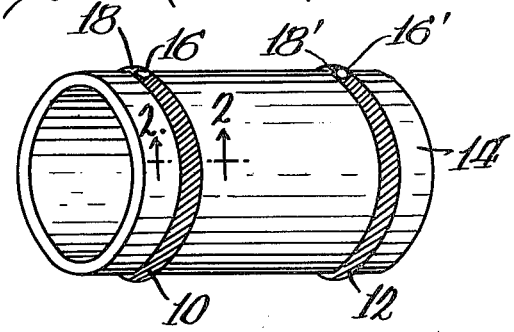
Fig. 1. (PRIOR ART)
Figure 2:
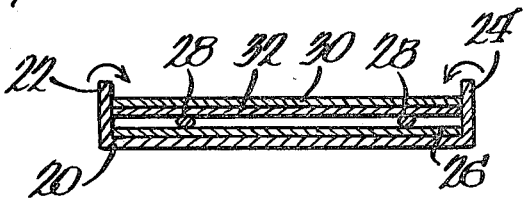
Fig. 2. (PRIOR ART)

Referring to FIGS. 1 and 2 of the drawings, heater bands 10 and 12 are secured to the surface of an extruder barrel 14 containing plastic for injection molding, for example. Terminals 16 and 18 or 16' and 18' are connected with an electrical power source, and the heating element in each of the heater bands 10 and 12 imparts sufficient heat through barrel 14 to maintain the plastic or other material in barrel 14 in a liquid state.

Referring to FIG. 2, a typical heater band, such as heater band 10, is shown to include a metal base 20 made of sheet metal or the like and having upwardly extending ears or tabs 22 and 24. An insulative sheet 26 extends along the base 20 and a heating element 28 is electrically insulated from metal cover 30 by an insulative sheet 32. After the metal cover 30 has been placed over sheet 32, the tabs or ears 22 and 24 are deformed inwardly, as shown by the arrows, to capture the metal cover 30, retaining it therebetween. A more detailed description of the method of making the heater band is found in Browne U.S. Pat. No. 2,976,387.

Although the heater band described above is satisfactory for many purposes, care must be taken to assure that the lower portion of the base 20 is in intimate contact with barrel 14 for efficient heat transfer therebetween. In the event there is a space or gap between the heater band 10 or 12 and the barrel 14, the heat from the heating element 28 cannot be sufficiently dissipated by base 20 and cover 30, causing heating element 28 to burn out. Because of the possibility of interrupted heat transfer between the heater band and an adjacent container, the wattage of the heating element is often limited to avoid an element burn-out.

DESCRIPTION OF THE PREFERRED EMBODIMENT

Figure 3:
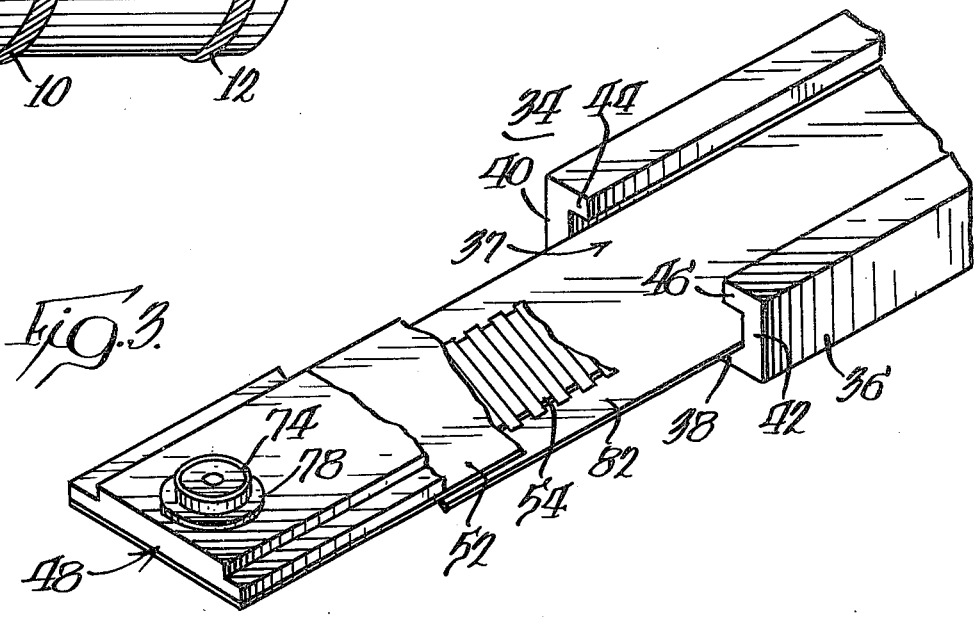
FIG. 3 is a perspective view, partly broken away, depicting the heater band of the present invention.
Figure 4:
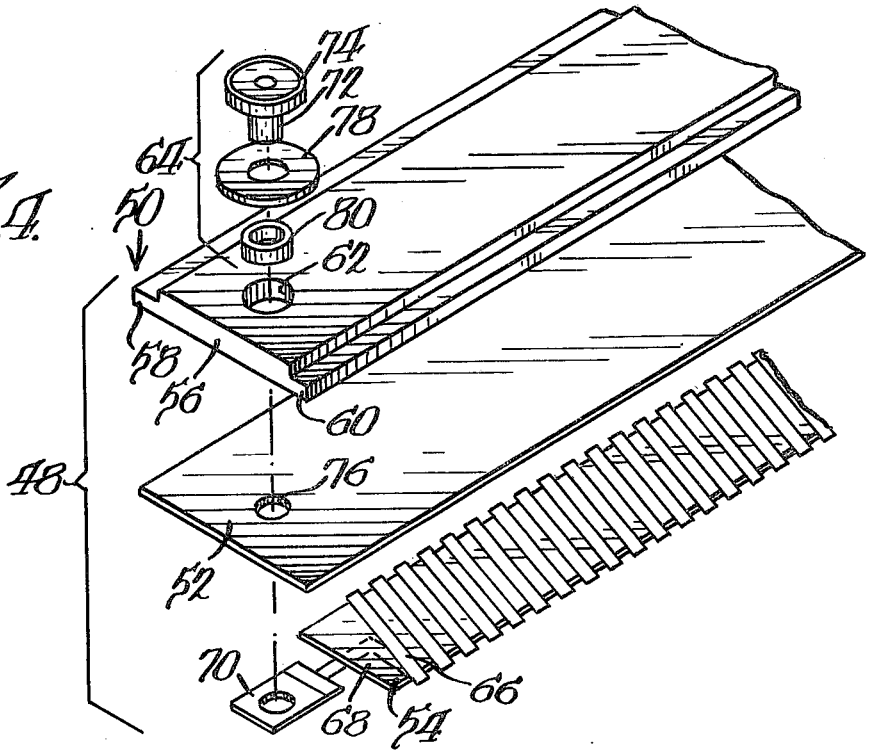
FIG. 4 is a detailed perspective view of the heater plate assembly of the heater band shown in FIG. 3.
Figure 5:
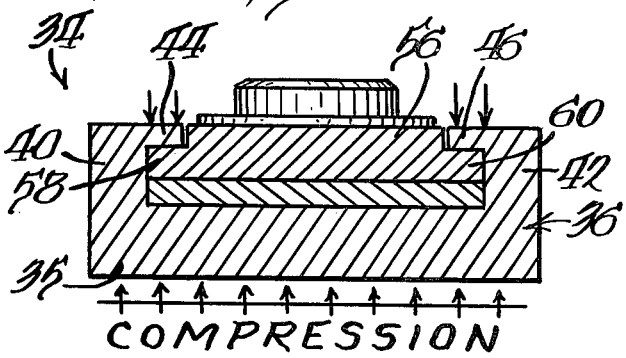
FIG. 5 is a cross-sectional view of the heater band in accordance with the present invention.

Referring to FIGS. 3–5, the heater band 34 includes a channel member 36 having a slot 37 extending along its length. Channel member 36 is preferably an extrusion and includes a base portion 38 and upstanding sides 40 and 42 having inturned flanges 44 and 46, respectively. The channel member 36 may be of any suitable material including aluminum, and its thickness, as ¼", is sufficient for dissipating heat.

A heater plate assembly 48 includes a cover 50, electrical insulating sheet 52 and heating element 54. The cover 50 includes a center core 56 and side portions 58 and 60 which extend outwardly from and have a thickness less than core 56. The width of the core 56 and the width of the side portions 58 are selected so that core 56 spans the distance between the ends of flanges 44 and 46, as best seen in FIG. 5. The side portions 58 and 60 are located beneath flanges 44 and 46. The thickness of core 56 and the thickness of the side portions 58 and 60 are selected so that the upper surface of the core 56 is substantially coincident with the surface formed by the upper portion of the flanges 44 and 46. The thickness of the side portions 58 and 60 is selected to fit beneath flanges 44 and 46. The cover 50 is provided with a bore 62 at each end to receive an electrical connector assembly 64, as will be explained below.

The heating element 54 includes a ribbon resistor 66 wrapped about a mica center 68, and is secured to a flat metallic connector 70.

The heater assembly 48 is assembled by laying the cover 50 over heating element 54 with electrical insulating sheet 52, as a mica sheet, therebetween. Connector assembly 64 retains the heating element 54 adjacent the cover 50 and provides an electrical connection to connector 70 of ribbon resistor 66. Specifically, a shank 72 of a terminal 74 extends through bore 62, a bore 76 in the insulating sheet 52, and through connector 70. The end of the shank is peened or soldered to mechanically and electrically engage the underportion of connector 70. Insulating washers 78 and 80 assure that the terminal 74 does not short with the cover 50.

Once the metal channel member 36 and the heater plate assembly 48 are formed, the assembly 48 is inserted into slot 37 of the channel member 36, as indicated in FIGS. 3 and 6. An insulating sheet 82, as mica, is disposed between the channel member 36 and the heater assembly 48 to electrically insulate the heating element 54 from the channel 36.

After inserting the heater assembly 48 into slot 37, the entire assembly is compressed, as by rolling, to form a highly dense cross section for good heat transfer. The compression is provided between the upper surfaces of the flanges 44 and 46 and the lower surface of the channel member 36, as indicated by the arrows in FIG. 5. After the heater plate assembly and the extrusion have been compressed, the ends of the heater band may be capped and welded to prevent the entry of contamination.

It is apparent that the heater band 34 may be employed as a straight length which can be provided with conventional fins secured thereto. The heater band 34 may also be formed in a semicircular configuration, as best seen in FIG. 7, having a radius to conform to the surface of a container to be heated. Alternatively, the heater band may be formed in a circle, as best seen in FIG. 8. If the semicircular or circular bands are to be adjacent a cylindrical container, conventional stainless steel external banding may be employed to assure intimate contact of the heater with the container.

I claim:

1. A method of making a heater band comprising the steps of:

forming an extruded channel member having a relatively thick cross-section throughout and a T-shaped slot therein defined by inwardly directed flanges;

forming a heater plate assembly adapted to be received within the slot, said plate assembly formed by securing an electric heating element to a metal plate;

combining said heater plate assembly with said slot of said channel member so that said heating element is retained within said slot; and compressing said heater plate assembly and said channel member to provide intimate contact between said heater plate assembly and said channel to thereby form the heater band.

2. The method of claim 1 wherein the step of combining the heater plate assembly with said slot includes:

sliding said heater plate assembly into said slot.

3. The method of claim 1 further including the step of forming said heater band into a semicircle.

4. The method of claim 1 further including the step of forming said heater band into a circle.

5. The method of claim 1 further including:

interposing electrical insulation between said heating element and said plate.

6. The method of claim 1 further including:

providing electrical insulation between said heater plate assembly and said channel.

7. A method of making a heater band comprising the steps of:

extruding a channel having a base, upstanding side walls, and inturned flanges all of which are relatively thick in cross-section and which thereby form a T-shaped slot within said channel;

forming a generally rectangular cover plate having a relatively thick cross-section and longitudinal grooves extending inwardly from two corners adjacent one longer surface of said plate, said grooves conforming to the thickness and width of said flanges;

forming a heater plate assembly by securing an electric heating element to said cover plate;

combining said heater plate assembly and said channel so that said plate grooves are retained by said channel flanges;

compressing said flanges to provide intimate contact between said plate, said heating element and said channel base, thereby forming the heater band.

8. The method of claim 7 further including:

interposing electrical insulation between said heating element and said cover plate.

9. The method of claim 7 or 8 further including:

positioning electrical insulation between said heater plate assembly and said channel.

10. The method of claim 9 further including:

forming the completed heater band into a semi-circle.

11. The method of claim 9 further including:

forming the completed heater band into a circle.

12. A method of making a heater band comprising the steps of:

extruding a channel having a relatively thick base, upstanding side walls, and inturned flanges which thereby form a T-shaped slot within said channel;

forming a cover plate having a central core defined by top and bottom surfaces and two sides and including webs of reduced thickness with respect to said core extending from each side a distance corresponding to the distance said flanges extend from said side walls, the height from said reduced thickness to said top surface corresponding to the thickness of said flanges;

forming a heater plate assembly by securing an electric heating element to said cover plate and interposing electrical insulation therebetween;

combining said heater plate assembly in said channel so that said webs are retained by said flanges;

interposing electrical insulation between said heater plate assembly and said channel base;

compressing said flanges to provide intimate contact between said plate, said electrical heater, said insulation and said channel base; and forming the compressed combination into an arcuate shape, thereby forming the heater band.

* * * * *